US005711451A

United States Patent [19]

Gavin

[11] Patent Number: 5,711,451

[45] Date of Patent: Jan. 27, 1998

[54] CONCRETE TANK SUPPORT SYSTEM

[76] Inventor: Norman W. Gavin, 2545 Ridge Rd., North Haven, Conn. 06492

[21] Appl. No.: 698,488

[22] Filed: Aug. 15, 1996

Related U.S. Application Data

[63] Continuation of Ser. No. 511,196, Aug. 4, 1995, abandoned.

[51] Int. Cl.[6] ..... B65D 90/14

[52] U.S. Cl. ..... 220/636; 220/565; 220/567; 220/632

[58] Field of Search ..... 220/565, 567, 220/638, 636, 632, 628, 1.5; 248/154, 633

[56] References Cited

U.S. PATENT DOCUMENTS

| | | | |
|---|---|---|---|
| 1,663,102 | 3/1928 | Taylor | 220/1.5 |
| 1,751,344 | 3/1930 | Mason | 220/636 |
| 2,273,601 | 2/1942 | Thomas | 220/567 |
| 2,287,197 | 6/1942 | Sandberg | 220/565 |
| 2,287,198 | 6/1942 | Sandberg | 220/565 |
| 2,295,514 | 9/1942 | Brinkman | 220/1 |
| 2,358,805 | 9/1944 | Horton | 220/69 |
| 2,359,683 | 10/1944 | Sandberg | 220/565 |
| 2,375,442 | 5/1945 | Sandberg | 220/18 |
| 2,952,945 | 9/1960 | Walleker | 50/25 |
| 3,047,190 | 7/1962 | Bayer | 220/628 |
| 3,608,204 | 9/1971 | Ashby | 34/218 |
| 4,344,645 | 8/1982 | Kirk | 285/61 |
| 4,640,328 | 2/1987 | Arney | 150/55 |
| 4,655,360 | 4/1987 | Juhanson | 220/632 |
| 4,735,457 | 4/1988 | Bonerb et al. | 220/1.5 |
| 4,742,933 | 5/1988 | Panick | 220/628 |
| 4,948,519 | 8/1990 | Zeh | 220/567 |
| 4,986,436 | 1/1991 | Bambacigno et al. | 220/86 R |
| 5,064,091 | 11/1991 | Gerhard | 220/1.5 |
| 5,064,155 | 11/1991 | Bambacigno et al. | 248/146 |
| 5,131,670 | 7/1992 | Clemens et al. | 248/154 |
| 5,271,493 | 12/1993 | Hall | 220/469 |
| 5,282,546 | 2/1994 | Bauer | 220/565 |
| 5,285,914 | 2/1994 | Del Zotto | 220/4.12 |
| 5,299,709 | 4/1994 | Beerbower et al. | 220/445 |
| 5,450,978 | 9/1995 | Crisp et al. | 220/565 |

FOREIGN PATENT DOCUMENTS

| | | | |
|---|---|---|---|
| 236087 | 9/1910 | Germany | 37/3 |

*Primary Examiner*—Stephen J. Castellano
*Attorney, Agent, or Firm*—Robert A. Seemann

[57] ABSTRACT

A concrete liquid storage tank is supported by only three support points which rest upon a slab in permanent installation, which prevents twist forces being applied to the concrete shell of the tank in the event of vertical differential movement of portions of the slab under the support points, which prevents cracking of the concrete shell and leakage of contents to the environment.

3 Claims, 4 Drawing Sheets

CONCRETE TANK SUPPORT SYSTEM

This application is a continuation of application Ser. No. 08/511,196, filed Aug. 4, 1995 now abandoned.

BACKGROUND OF THE INVENTION

1. Field of the Invention

This invention pertains to concrete receptacles, more specifically to a stationary concrete receptacle with container and combined support system, for petroleum products wherein the receptacle is of the 100,000 lb to 200,000+ lb class when loaded with product, in which the concrete receptacle withstands without fracturing, shifting and vertical movement of the ground and cracking failure of the slab upon which the receptacle rests.

The concrete receptacle, or concrete tank, of which this invention is concerned comprises a monolithically cast and generally rectangular shell having a width of about 8 feet, a height of 6 feet to 9 feet, a length of 11 feet to 34 feet, and a capacity in the range of about 2,000 to 12,000 gallons. The shell contains a metal tank for holding the liquid, and is mounted on a concrete slab which rests upon the ground. Preferably a layer of Styrofoam (™) and a polyethylene secondary containment sleeve surrounds the metal tank within the concrete shell.

The concrete shell is subject to potentially damaging stress from differences in expansion and contraction of the contained liquid and tank, and from expansion, and contraction, and sinking and heaving of the slab upon which the shell rests and of the earth supporting the slab.

2. Description of the Prior Art

U.S. Pat. No. 2,358,805 patented Sep. 26, 1994 by G. T. Horton describes an elevated steel tank having a cylindrical body in which the bottom is formed of at least three inverted steel cones with downwardly diverging axis which when projected upward intersect the vertical axis of the cylinder substantially at the center of gravity of the body. Supporting members such as legs which also may contain the liquid stored in the tank, extend downwardly from the apices of the cones substantially in alignment with the axes of the cones.

In U.S. Pat. No. 2,375,442, Patented by W. A. Sandberg, May 8, 1945, a tank is supported by two pairs of columnar legs, one of each of the pairs mounted toward opposite ends of the tank. Each pair of legs is mounted on one of two transverse concrete foundation slabs. One of the pairs has swiveling joints at the upper and lower ends of the legs so that the tank can move slightly longitudinally at that end. The other pair is mounted with close fitting, slidingly, vertically telescoping fittings, so that the tank has slight vertical play and no horizontal play at that end.

U.S. Pat. No. 4,344,645, patented Aug. 17, 1982 by K. L. Kirk, describes a cylindrical tank having a tee-type 3-leg bracket. Each leg is generally triangular with one wall of the triangle matching the contour of the tank, and a foreshortened apex of the triangle attached to a central hub below the tank by sliding the triangle into an axial slot along the outside of the hub, so that the three triangular legs radiate outward from the hub. The assembly rests upon the corners of the remaining walls and bases of the triangular legs. The bracket is made self leveling by the ability of the triangular legs to slide vertically (axially) on the hub.

U.S. Pat. No. 5,064,155, patented Nov. 12, 1991 by Bambacigno et al., describes a support system in which a pair of elongated troughs having side walls angled outward from the bottom to the top, are mounted on a slab which supports a rectangular concrete tank. The tank has two concrete bars, each of which is transverse to the length of the tank, across the tank at one end of the tank on the bottom wall of the tank, parallel with the bar at the other end. The slab is exposed at the bottoms of the troughs, and the tank is supported by the bars directly on the slab at the bottoms of the troughs. The walls of each trough extends the length of and around the ends of the bar that it contains, and prevent horizontal shifting or sliding of the tank in the event of an earthquake, to prevent rupture of external pipes or the tank colliding with another tank or structure.

A system which has been used by United Concrete Products, Inc., 173 Church St., Yalesville, Conn., for installing a concrete tank of the type concerned on a concrete slab, includes having two concrete bars on the bottom wall of the tank. Each bar is transverse to the length of the tank, across the tank at one end of the tank, and parallel with the bar at the other end of the tank.

To install the tank permanently on the slab, the tank is rested on four square 60 durometer pads, two under each bar spaced apart about one half of the length of the bar. Each pad is a little wider than the bar that it supports. Temporary seals between the outer walls of the bars and the slab are placed around the ends of the bars so that a hollow cavity is formed under the end of each bar between the bar and the slab.

A hole is then drilled in the end of each bar, angled down to the cavity. Liquid grout is injected into the cavity by way of the hole. After 24 hours the seal is removed.

U.S. Pat. No. 5,299,709, patented Apr. 5, 1994, by Beerbower et al., describes a support system in which the tank has two concrete bars, each of which is transverse to the length of the tank, across the tank, at each end of the tank on the bottom wall of the tank, parallel with the bar at the other end. A 60 durometer ½ inch thick resilient neoprene bearing pad extends the length of the bottom of each bar for supporting the tank on an appropriate slab.

The art is replete with horizontal continuous double bar, and vertical three and four leg support systems for permanently mounting metal tanks, and horizontal double bar and vertical four leg support systems for permanently mounting concrete tanks, and it is not uncommon to temporarily support items on two, three, or four legs. Yet to the knowledge of the inventor there is no permanent mounting support system for large, heavy concrete tanks of the present concern which have the invention's three point system that prevents dangerous and environmentally damaging stress cracking from destabilizing influences.

SUMMARY OF THE INVENTION

It is one object of the invention to provide a support system for permanently mounting a large, oblong, horizontal, concrete, liquid storage tank on a concrete slab or similar platform, which prevents cracking of the concrete shell of the tank from uneven vertical movement of portions of the slab or earth underlying the tank.

It is another object of the invention that the support system is inexpensive to install.

It is another object of the invention that precise positioning of the tank on the slab is not required during installation of the tank on the slab.

It is another object that a sink or upthrust of a supporting portion of the slab will not twist the concrete shell of the tank.

It is an object that a sink or upthrust of a supporting portion of the slab will not stress crack the tank.

It is another object that shimming, adding or injecting concrete, screwing, jacking or other fine tuning or adjustments of the support system are not required at any time, such as before, during or after installation of the tank on a slab.

Other objects and advantages of the invention will become apparent to one reading the ensuing description.

In a liquid storage tank which includes a cementitious outer shell, a support system includes a pair of support points mounted on the tank and consisting of a first support point and a second support point that is horizontally spaced from the first support point. The pair of support points are at a first end of the tank, the first end being supported by the pair of points.

A third support point is also mounted on the tank. It is spaced from the first support point and from the second support point, and is at the second end of the tank. The second end of the tank is supported by the third support point.

All three support points are below the tank, preferably on a bottom wall of the shell.

The pair of support points are on a first line that is generally normal to a balance line of the tank. The third support point is generally on a balance line of the tank.

Preferably all three support points are mounted on the tank so that the tank is supported by the three points to be at a balance on a predetermined tank balance line.

The bottom wall of the shell includes a bar that is attached to the bottom wall and that extends below the bottom wall, the third support point being on the bar, being a resilient pad attached to the bar, and being shorter in length than the bar.

Also included is a cementitious slab. The slab has sufficient strength at a discrete point which coincides with the third support point when the fluid storage tank is on the slab with the third support point resting upon the discrete point, to support more than half of the weight of the liquid storage tank fully loaded.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
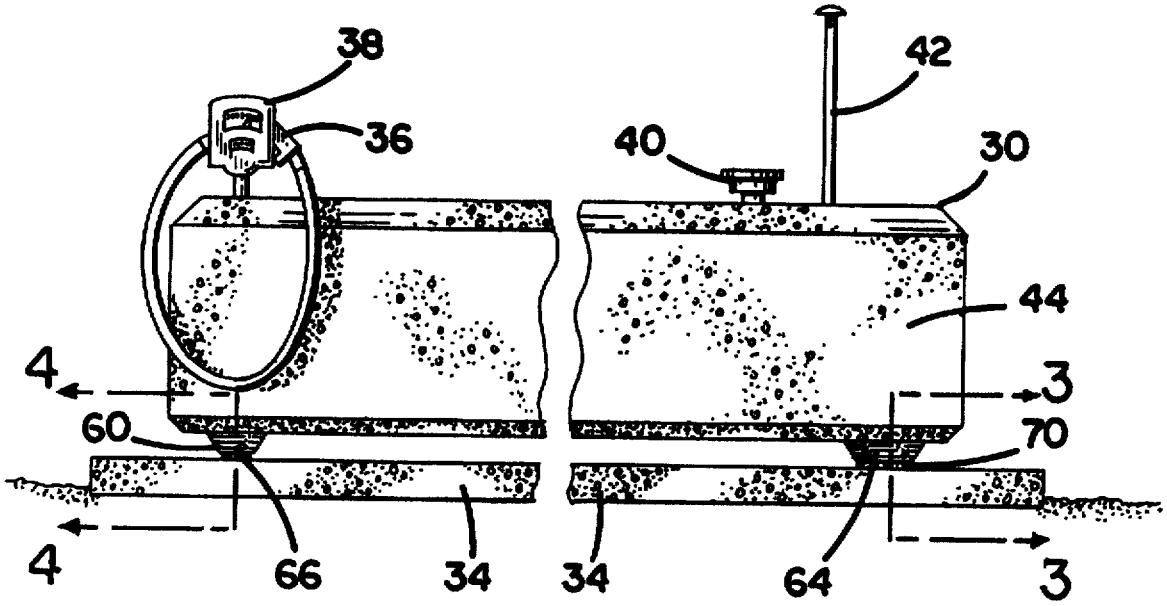
FIG. 1 is a front view of a concrete tank mounted on a concrete slab according to the invention.
Figure 2:
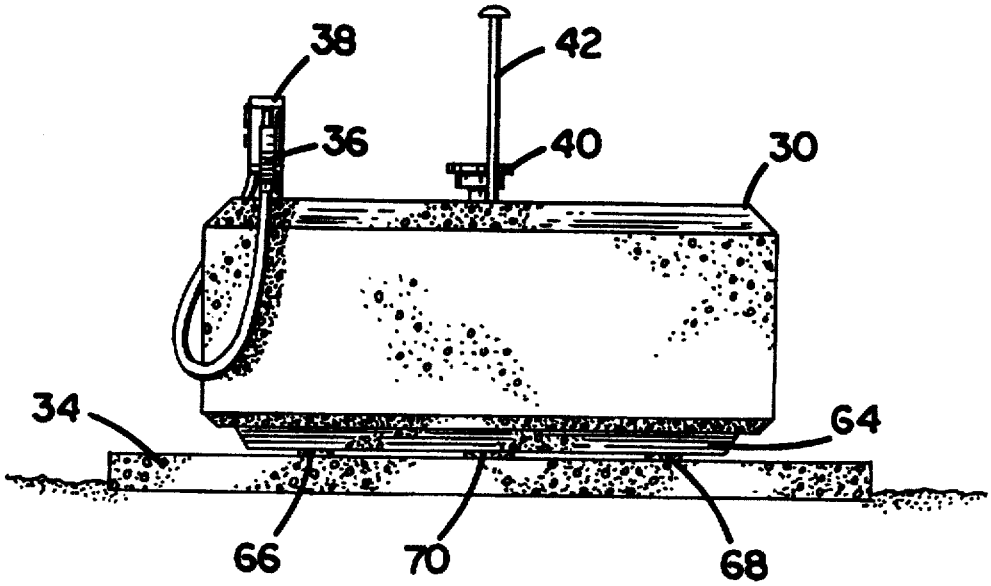
FIG. 2 is a right side view of the tank and slab of FIG. 1.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Referring to FIGS. 1–4, liquid storage tank 30 rests upon concrete slab 34. Tank 30 is capable of storing gasoline, oil, and many petroleum or chemical products, but features a diesel oil fuel delivery nozzle 36 attached to an electric, metered delivery pump 38. The tank is filled through pipe 40, and is vented by pipe 42.

Monolithically cast concrete outer shell 44 of tank 30 contains steel tank 48 insulated by a layer of Styrofoam (™) 50 which is surrounded by polyethylene containment bag 54. Bag 54 is preferably a 30 mil thick high-density carbon lined polyethylene Geo-membrane.

This is called a "protected tank system" because the primary vessel 48, which is a steel tank, is surrounded by a secondary vessel, polyethylene bag 54, which when supported by concrete shell 44, can hold 110% of the liquid that is in primary vessel 48 should primary vessel 48 leak or rupture.

The protected tank system is tested under pressure to make sure that the primary vessel can hold a full load, and if the primary vessel should leak or fail, that the secondary vessel bag 54, can retain the load.

In another concrete tank system, the secondary vessel is provided by a sealant coating of the inner surface of the concrete shell, such as in U.S. Pat. No. 5,299,709 described earlier. A thermosetting resin is used for secondary containment of chemicals, and a water and polymer-based sealant is used for secondary containment of fuels.

In a "nonprotected tank system", the secondary vessel is outside the tank system. This is usually a dike or trough which surrounds the tank assembly, and is designed to hold 110% of the liquid that the liquid storage tank can hold, should the liquid storage tank leak or rupture.

The purpose of secondary vessels is to prevent or reduce the chance of fire and pollution of the adjacent environment if the primary vessel fails.

A crack of the concrete shell of one of the above systems can result in gas, oil or chemical release to the earth or air. The crack can cut or tear a polyethylene bag secondary vessel, and it can propagate through a sealant coating secondary vessel.

Concrete tanks such as those discussed above are extremely heavy and massive. For example, a 4,000 gallon steel tank will weigh about 3,900 pounds, and a 12,000 gallon steel tank will weigh about 12,000 pounds. By comparison, equivalent capacity concrete tanks weigh about 45,000 pounds and 101,000 pounds respectively. The weight can double when the product is added, such as gasoline at six pounds per gallon or chemicals at eight pounds per gallon.

The concrete shell is relatively inflexible, and will crack under its own weight if twisted. The concrete slab will also crack for the same reason if twisted under load, such as by changing ground forces.

In order to prevent twist, it is the practice in permanent installation to spread the load on the concrete slab, and to provide as much even and uniform support as possible for the concrete shell. It is the installation practice to use anywhere from four support points to an infinite number of support points between the tank and the slab.

Twist, however, will occur when the concrete slab upon which a four point supported concrete tank breaks and a portion supporting the tank at one of the points sinks in soil or is thrust upward by frost. This applies forces to the shell which drive toward separating one of the support points from the slab, sending twisting forces through the shell.

Increasing the support area from four discrete points such as four vertical legs, to continuous contact, or an infinitely large number of support points, such as between a pair of horizontal bars and the slab, does not prevent twist of the shell when a supporting portion of the slab moves vertically.

In the present invention the slab is strengthened to support the weight of one half of the loaded tank upon a single load point at about the center of the slab under one end of the tank, and the tank is rested on the single load point by a single support point at the one end of the tank and on two support points at the other end of the tank. Although the slab is unevenly loaded, and the tank is unevenly supported pointwise, this is a substantially safer way to support the tank.

If the slab cracks and a portion of the slab under a support point moves vertically due to the ground sinking or rising from frost as can happen with the best laid slab, the tank will lean or rotate as a whole unit. It will follow the change, but will not twist. This is because with the three point system, no matter which and how many of the different supporting portions of the slab move vertically, full supporting contact between all three load points of the concrete shell and the slab will continue with no change in supportive loading to the tank at each point except for the minor shift in gravity from the tilt of the tank. By comparison, a perfectly set, evenly load balanced, four point mounted concrete tank on a flat slab will be subjected to a change in the balance of support forces, causing twist, when a portion of the slab under even just one of the points thrusts up, or drops away from contact with the tank.

Even though the best laid slab may fail, the tank is prevented from being cracked by the change in slab support.

Figure 3:
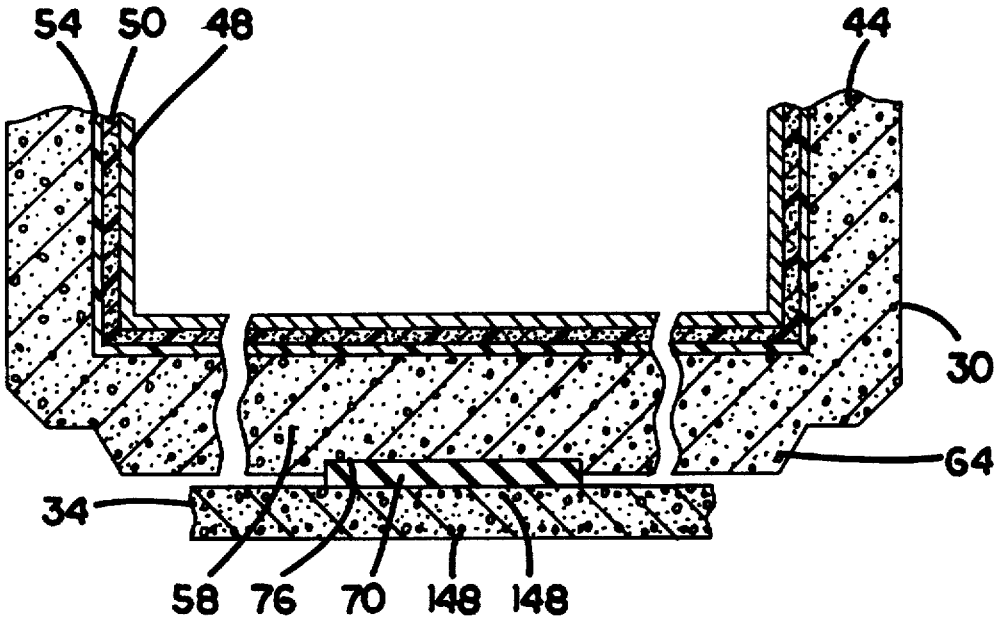
FIG. 3 is a partial cross section view of the tank and slab of FIG. 1, taken along 3—3.
Figure 4:
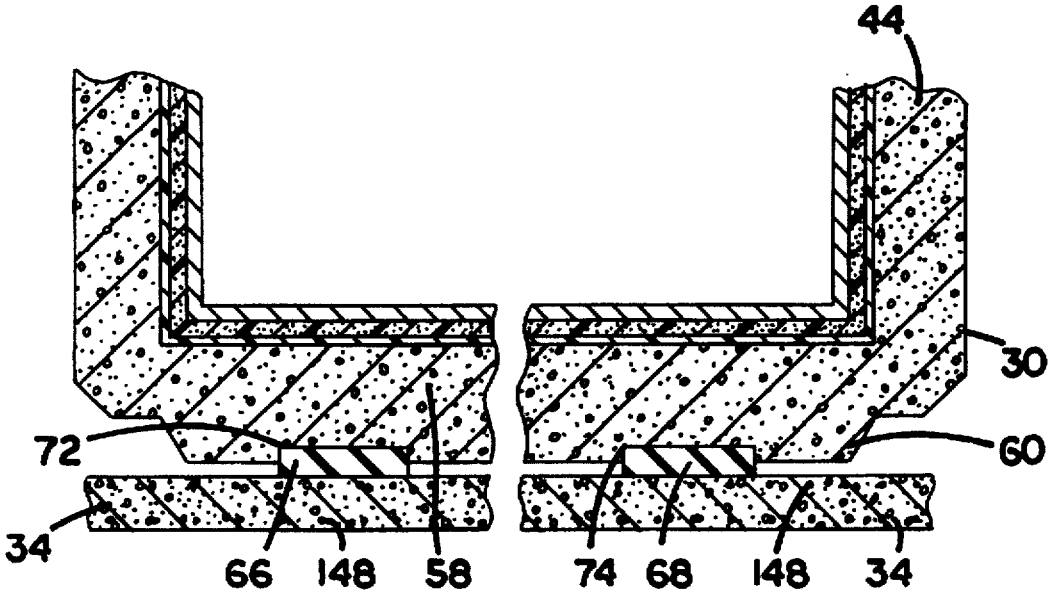
FIG. 4 is a partial cross section view of the tank and slab of FIG. 1, taken along 4—4.
Figure 5:
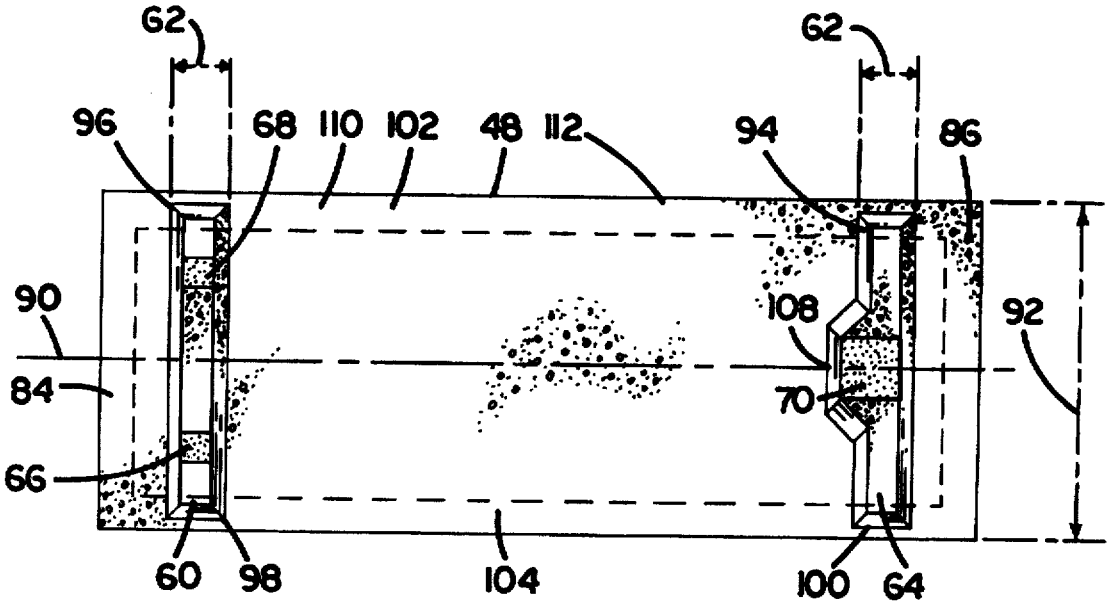
FIG. 5 is a bottom view of the tank of FIG. 1.

FIGS. 3–5 show a preferred arrangement of the present invention. Cross bars 60 and 64 are cast on bottom wall 58 and extend below the bottom wall as part of shell 48.

Figure 6:
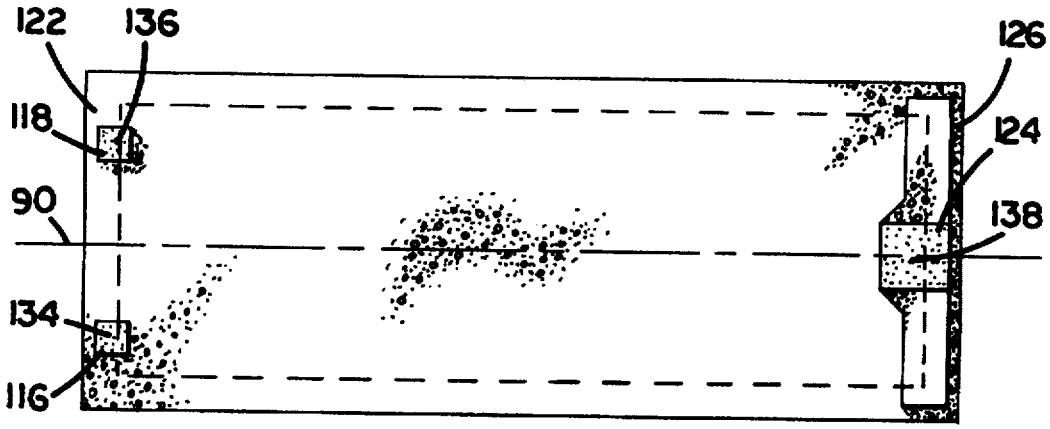
FIG. 6 is a bottom view of another tank having the present invention.

Pads 66, 68, and 70 are resilient, 60 durometer, approximately 1" thick neoprene squares. Pad 70 is about twice the length on a side as pad 66 or 68. As shown in FIGS. 4, 5, and 6, the pads are preferably rigidly mounted on the tank.

The pads are set into square depressions 72, 74 and 76 which are formed in the cross bars during casting of the shell, and extend outward from the cross bars so as to provide the three support points that rest on slab 34 in order to support shell 44 on the slab.

The cross bars are parallel with end walls 84 and 86, and normal to center line 90 which bisects width 92 of shell 44, and which is generally parallel with the balance line of the tank. Ends 94, 96, 98, and 100 of the cross bars extend over the lower ends of side walls 102 and 104.

Cross bars 60 and 64 are of about the same width 62 at the ends. Cross bar 64 is enlarged at the center 108 of the bar to twice the width of the width of cross bar 60, and has pad 70 at the large center 108.

Pads 66 and 68 share the weight load of the left half 110 of the tank, and pad 70 takes the weight of the right half 112 of the tank.

FIG. 6 shows another arrangement of the invention. Pads 116 and 118 extend over end wall 122. Pad 124 extends over end wall 126. They provide support points 134, 136, and 138 respectively which rest on the slab.

Figure 7:
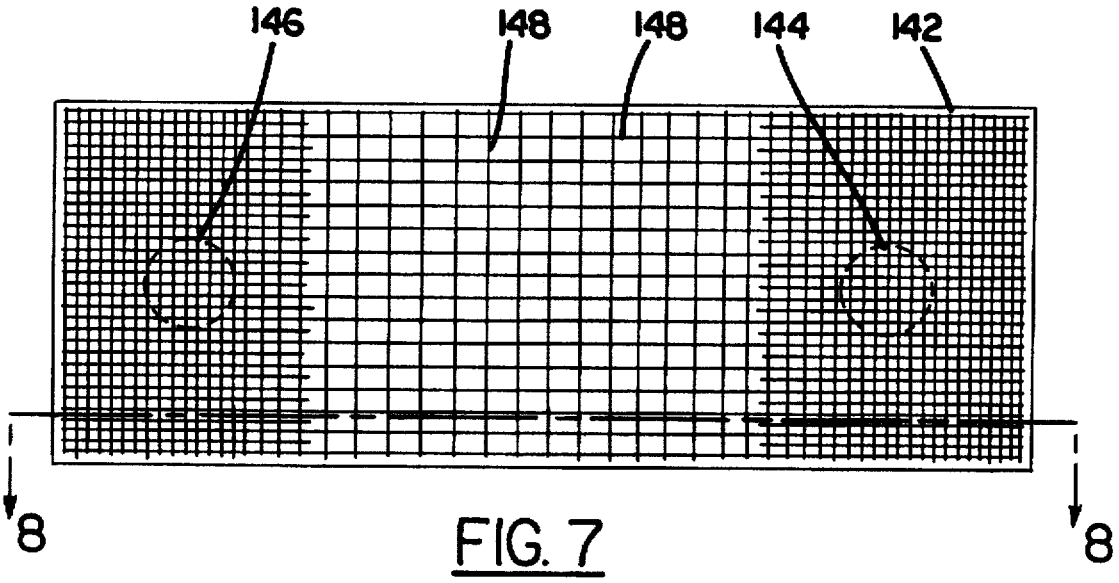
FIG. 7 is a top schematic view of rebar reinforcement of a slab of the invention.
Figure 8:
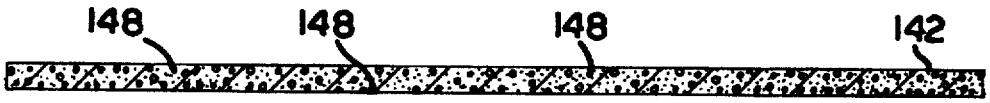
FIG. 8 is a partial cross section view of the rebar reinforcement of the slab of FIG. 7, taken along 8—8.

In FIG. 7, and 8, concrete slab 142 is reinforced by steel rebar 148 so that it can support at least half the weight of a full tank at a single load point 144 below the center line of the tank. Load point 144 is the recipient of the single, sole support point at one end of the tank.

Reinforcement may also be provided for convenience at 146 so that the tank can be installed on the slab with the single load point at either end of the slab.

The above descriptions are made for a tank having the primary vessel symmetrical with the outer shell. Generally the primary vessel is symmetrical with the concrete outer shell so that the center of gravity of the tank does not shift between an empty and a full primary vessel. It should be clear, however, that the pattern of the three point support will be different when it is required to support a non-symmetrical mass. For example, the third support point may be off the center line of the shell in order to support a tank that has a balance line off the center line of the shell.

Figure 9:
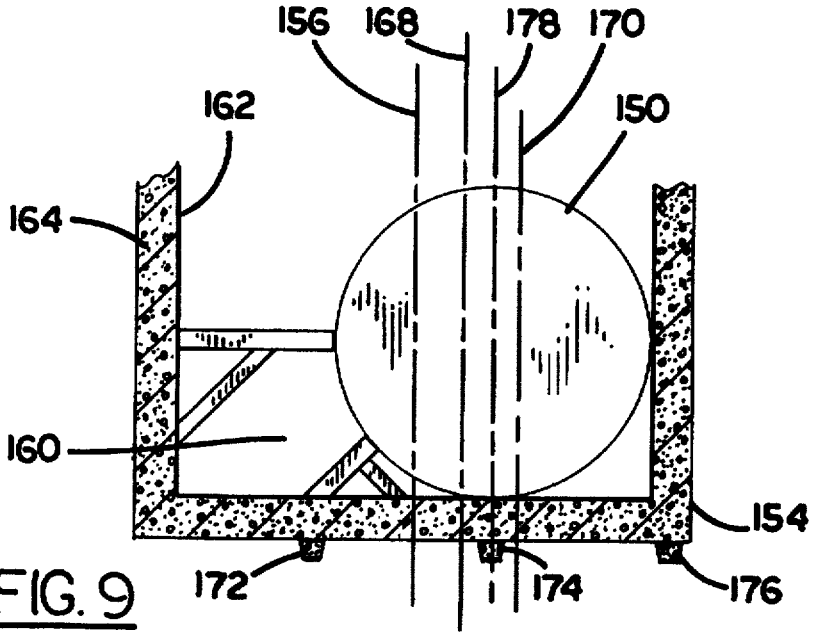
FIG. 9 is a partial cross section view of a concrete tank with the present invention.

In FIG. 9, primary vessel 150 is mounted off tank 154 center line 156. Secondary vessel 160 is provided by epoxy sealant coating 162 on the inside wall of concrete shell 164. This arrangement results in tank balance line 168 when the primary vessel is empty, and tank balance line 170 when the primary vessel is full. Support points 172, 174, and 176 are off center of the tank and support the tank so as to balance on a balance line 178 that is between balance lines 168 and 170.

Although the invention has been described in terms of specific preferred embodiments, it will be obvious to one skilled in the art that various modifications and substitutions are contemplated by the invention disclosed herein and that all such modifications and substitutions are included within the scope of the invention as defined in the appended claims.

I claim:

1. A liquid storage tank having a length, a width, a first end and a second end, said tank comprising:

a cementitious outer shell, a support system consisting of three support points, said three support points being:

a pair of support points mounted on said tank and consisting of a first support point and a second support point horizontally spaced from said first support point, said pair of support points being at said first end of said tank, said first end of said tank being supported by said pair of support points, and a third support point mounted on said tank, said third support point being substantially less than the width of the tank and being spaced from said first support point and said second support point and being at said second end of said tank, said second end of said tank being supported by said third support point, said first, second and third support points being below said tank and being rigidly mounted on said tank, said tank having a bottom wall, said mounting of the support points being on said bottom wall, said bottom wall of said tank comprising a bar attached to said bottom wall and extending below said bottom wall, said third support point being on said bar, said bar extending lengthwise substantially the width of said tank.

2. The tank of claim 1, further comprising:

said bar comprising a depression on the bottom of said bar, said third support point being a resilient pad attached to the bar, being shorter than the bar, being in said depression, and extending below said bar.

3. A liquid storage tank having a length, a width, a first end and a second end, a cementitious outer shell, a support system consisting of three support points, said support points being:

a pair of support points mounted on said tank and consisting of a first support point and a second support point horizontally spaced from said first support point, said pair of support points being at said first end of said tank, said first end of said tank being supported by said pair of support points, a third support point mounted on said tank, said third support point being substantially less than the width of the tank and being spaced from said first support point and said second support point and being at said second end of said tank, said second end of said tank being supported by said third support point, said first, second and third support points being below said tank, said tank having a bottom wall, said mounting of the support points being on said bottom wall, said bottom wall of said tank comprising a bar attached to said bottom wall and extending below said bottom wall, said third support point being on said bar, said bar extending lengthwise substantially the width of said tank, said bar comprising an enlarged portion of the bar, said third support point being on said enlarged portion.

* * * * *